US005603420A

United States Patent [19]

Swanson

[11] Patent Number: 5,603,420

[45] Date of Patent: Feb. 18, 1997

[54] METHOD FOR USING A TWO-DRUM CRANE FOR RAISING OR LOWERING A LOAD

[75] Inventor: Richard N. Swanson, South Milwaukee, Wis.

[73] Assignee: Harnischfeger Corporation, Brookfield, Wis.

[21] Appl. No.: 384,139

[22] Filed: Feb. 6, 1995

Related U.S. Application Data

[62] Division of Ser. No. 119,645, Sep. 13, 1993, Pat. No. 5,423,438.

[51] Int. Cl.[6] ..... B66C 1/26

[52] U.S. Cl. ..... 212/274; 254/285

[58] Field of Search ..... 212/312, 274, 212/318, 319; 254/284, 285, 399, 400, 413, 414, 415, 416

[56] References Cited

U.S. PATENT DOCUMENTS

| | | | |
|---|---|---|---|
| 2,068,638 | 1/1937 | Nichols | 254/399 |
| 2,357,443 | 9/1944 | Swanson | 212/274 |
| 3,308,966 | 3/1967 | Fawell | 212/274 |
| 3,557,974 | 1/1971 | Ostrander | 414/274 |
| 3,661,279 | 5/1972 | Macrander | 254/285 |
| 5,074,528 | 12/1991 | Long | 254/285 |
| 5,114,026 | 5/1992 | Van Ketel | 254/285 |

FOREIGN PATENT DOCUMENTS

| | | | |
|---|---|---|---|
| 663660 | 5/1979 | U.S.S.R. | 254/285 |

*Primary Examiner*—Thomas J. Brahan
*Attorney, Agent, or Firm*—Jansson & Shupe, Ltd.

[57] ABSTRACT

The disclosure involves a crane having a main hoist drum and an auxiliary hoist drum for handling a load under normal and emergency (the latter actual or simulated) conditions, respectively. The latter condition involves a main hoist which is inoperative because of a failure or by intent. The auxiliary hoist drum is wrapped with about twice the length of cable as the main drum and can move the load up or down, irrespective of load position if and when the main hoist becomes inoperative. Also disclosed is a novel method for moving a load. Steps include maintaining one drum in a non-rotating mode and rotating the other drum. An improved crane load block is also disclosed to have "floating sheaves" which help prevent excessive fleet angles.

6 Claims, 7 Drawing Sheets

FIG. 3
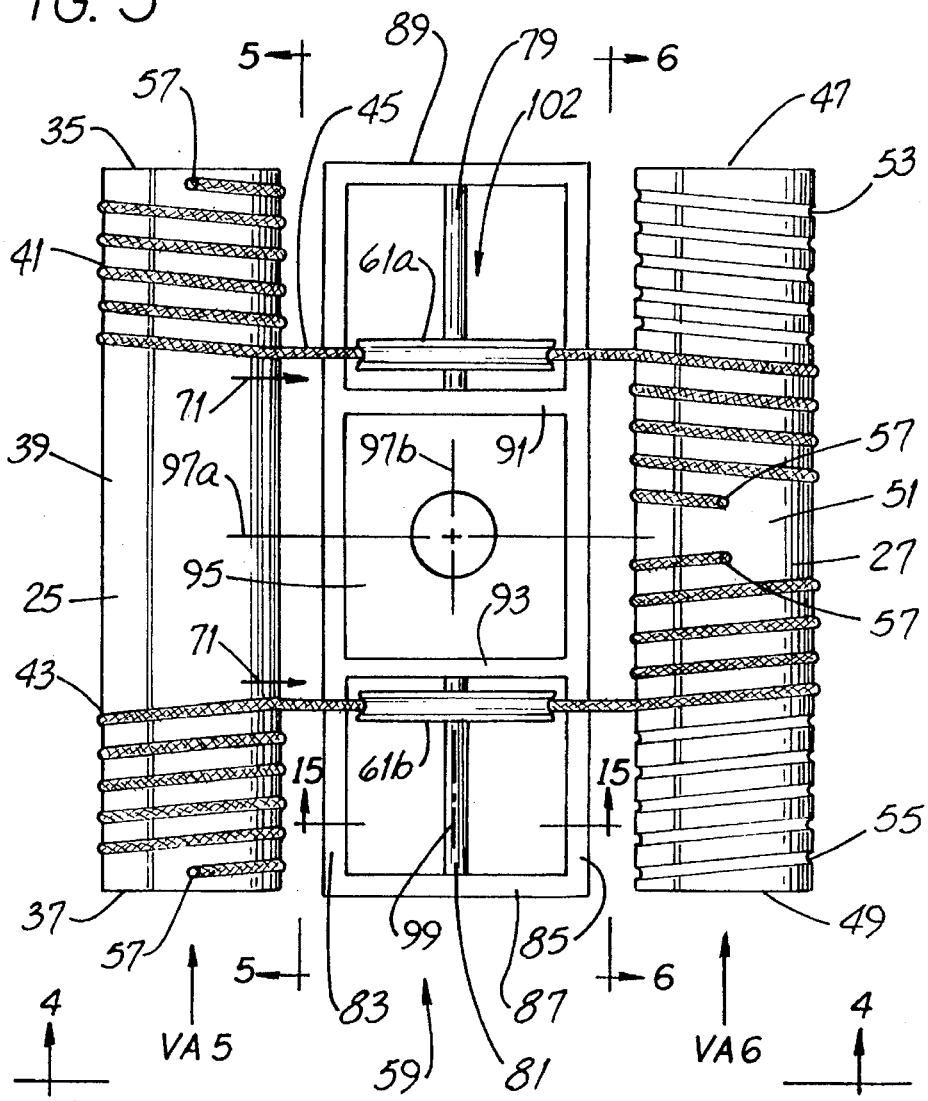
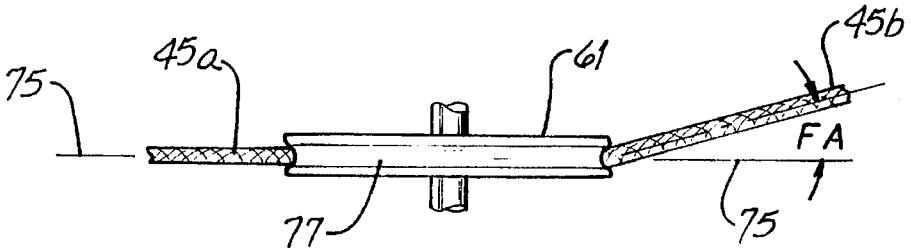
FIG. 10

FIG. 5
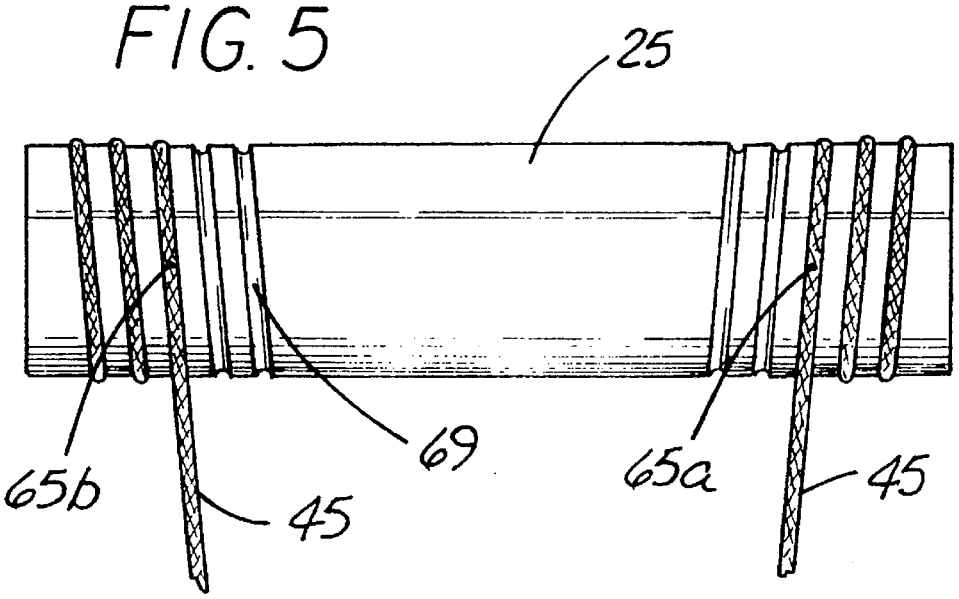
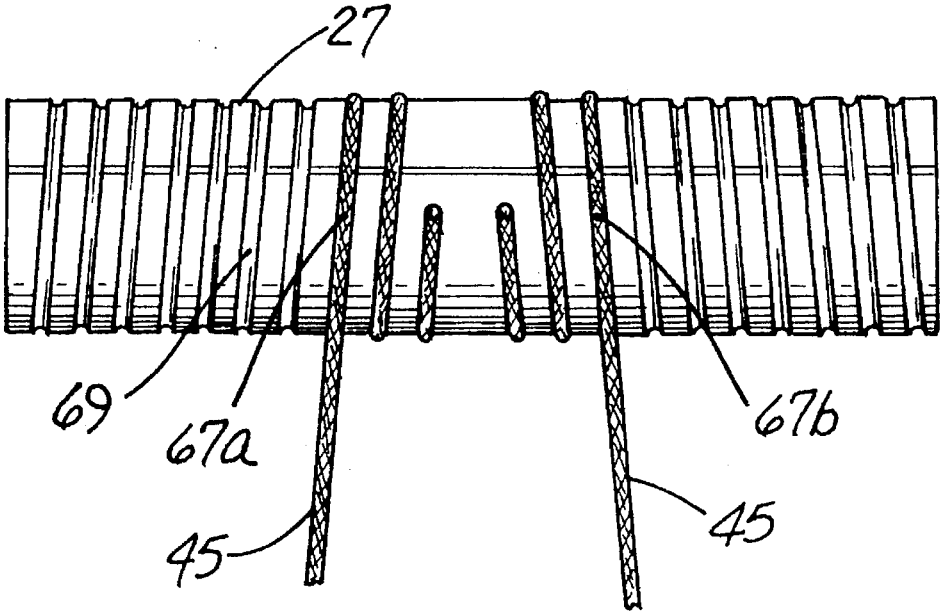
FIG. 6

METHOD FOR USING A TWO-DRUM CRANE FOR RAISING OR LOWERING A LOAD

RELATED APPLICATION

This application is a division of application Ser. No. 08/119,645 filed on Sep. 13, 1993, now U.S. Pat. No. 5,423,438.

FIELD OF THE INVENTION

The invention relates to material handling equipment and, more particularly, to cranes having traversing hoists.

BACKGROUND OF THE INVENTION

Material handling equipment is available in a wide variety of types including, for example, lift trucks, excavators, backhoes and cranes. The latter type includes overhead travelling cranes (OTC) which ride on spaced railroad-like rails mounted above a surface, e.g., the floor of a room. Another type of crane which has one or two stilt-like legs is referred as a gantry crane (having two supporting legs and resembling an inverted "U" in shape) or a half-gantry which is shaped like an inverted "L" and has one leg supported at ground level and the horizontal portion supported by an elevated rail. While the invention is described in connection with an OTC, persons of ordinary skill will understand how to apply its teachings to other types of cranes and even stationary hoist systems.

A typical OTC has a bridge which spans the rails and which has a trolley atop it. The trolley travels on spaced rails mounted on the bridge structure. Mounted on the trolley is a hoist system having a rotating drum powered through gearing by an electric motor.

Such system also has what is known as a "bottom block" or "load block" suspended from cable and equipped with a hook or other device for lifting a load. A load block has one or more pulley-like, rotatable sheaves over which cable runs. While not common, dual-hoist systems involving two simultaneously-operating hoist drums "cabled" to a single load block are not unknown. Insofar as is known, such hoist systems have a single control for operating two hoist motors in parallel, one attached to each hoist drum. In other words, it is not possible to operate a hoist drum independent of the other hoist drum.

The crane is able to travel the length of the bridge rails (along the length of a room, for example) and the bridge-mounted trolley can travel the width of such room. Therefore, by properly manipulating crane and trolley position, the operator can "pick" a load from about any location in the room and move it to any other location.

Many (indeed, perhaps most) applications for overhead travelling cranes are not so critical that they require redundant hoist systems. If a hoist system fails, operations are merely suspended for the time necessary to effect repairs. On the other hand, there are certain applications, usually involving some sort of hazard, where the potential risk justifies provision of a redundant system.

An example of an application of the latter type is a nuclear power station. There, fuel "charges" (bundled rods of radioactive nuclear fuel ready for placement in a reactor) need to be handled expeditiously as does the spent but still radioactive fuel residue removed from a reactor. It is sometimes not possible or desirable to leave a load of radioactive material at a location where humans might be exposed thereto while hoist repairs are undertaken.

As with other types of hoist systems, the matter of a primary and a redundant hoist system cabled to a single load block involves (or should involve) considerations of what is known as "fleet angle." The fleet angle is the included angle between a sheave-engaging cable and the plane of sheave rotation. Explained in different terms, when cable is aligned with the groove in a sheave across which the cable travels, the fleet angle is substantially zero. On the other hand, when cable is "cocked" and enters or leaves the sheave at an angle, this is understood to involve a fleet angle which is other than zero.

An excessive fleet angle can cause any one or more of several problems. One is that cable rubs on one of the pulley rims. Undue (and, in view of the invention, unnecessary) cable and rim wear result. Another problem is that in a more severe case involving very excessive fleet angle, cable may jump out of the pulley groove and "roll over" the pulley rim. Such an eventuality usually immediately disables the hoist system.

To explain the source of another type of difficulty, it is assumed that a hoist system has fully lowered a load and thereupon becomes disabled. It is also assumed that the system uses two "parts" of cable, a common arrangement providing a 2:1 lifting advantage, and is further assumed that the cable is wound on the drum in a way that the points of cable tangency become spaced further apart as the load lowers.

In this situation, it is apparent that if the load block is raised toward the main hoist drum using means other than by rotating such drum, the fleet angles increase. Such increases can lead to problems as described above.

The invention addresses these problems and shortcomings in unique and imaginative ways.

OBJECTS OF THE INVENTION

It is an object of the invention to provide an improved crane overcoming some of the problems and shortcomings of the prior art.

Another object of the invention is to provide an improved crane which can fully raise or fully lower a load in the event the main hoist system is disabled.

Another object of the invention is to provide an improved crane which helps reduce excessive cable-sheave fleet angle and problems relating thereto.

Still another object of the invention is to provide an improved method for moving the load in the event the main hoist system is disabled.

Another object of the invention is to provide an improved crane having a load block which helps avoid undue cable and sheave rim wear. How these and other objects are accomplished will become more apparent from the following detailed description and from the drawing.

SUMMARY OF THE INVENTION

Aspects of the invention involve a unique crane arrangement particularly useful for handling hazardous loads such as nuclear fuel and the spent residue thereof. In the event of failure of the main hoist drum, the load can be moved up or down by the auxiliary hoist drum. The drum cable grooves spiral in opposite directions and when cable is installed as described and the crane operated as described, the fleet angle is maintained at an acceptable value. A unique load block is disclosed and also helps reduce "cable-jump" and other problems arising from excessive fleet angle.

The crane has a first or main hoist drum, a second or auxiliary hoist drum and a load block with a load suspended from it. Cable extends between the drums and the block for raising and lowering the load. Such cables contact the main hoist drum at first points of tangency and contact the auxiliary hoist drum at second points of tangency.

In the improvement, the distance between the first points of tangency increases as the block is lowered and the distance between the second points of tangency decreases as the block is lowered. The crane moves a load between a fully lowered position and a fully raised position and the distances between points of tangency are about equal to one another when the load is in the fully raised position. On the other hand, when the load is in the fully lowered position, the distance between the first points of tangency is substantially greater than the distance between the second points of tangency.

The attachment points for the cables on the main and auxiliary hoist drums are located differently. That is, the main hoist drum has a pair of ends and cable is attached to the main hoist drum by at least one socket adjacent to at least one such end. The auxiliary hoist drum has a central portion and in contrast to the arrangement of the main drum, cable is attached to the auxiliary drum by at least one socket generally at such central portion.

In other aspects of the invention, each drum has first and second cable grooves spiralled in opposite directions from one another. Both drums have a pair of ends and a central portion and an end of each groove is bounded by a cable-attachment socket. Each socket of one drum is adjacent to a separate end of that drum and each socket of the other drum is at the central portion of that other drum.

In yet other aspects of the invention, a first length of cable is attached to the main hoist drum and a second length of cable is attached to the auxiliary hoist drum. In the improvement, the length of cable attached to the auxiliary hoist drum is about twice the length of cable attached to the main hoist drum.

In a nominal "starting" arrangement where the load has been fully lowered by the main hoist drum, about half the cable attached to the auxiliary drum is wrapped on the drum and about half extends down to the load block. In that way, the auxiliary drum can fully raise the load if the main hoist then fails or, if the load has been fully raised by the main hoist, there is sufficient cable on the auxiliary drum to fully lower the load.

An end of the first length of cable is attached to the main hoist drum by a separate first socket and an end of the second length of cable is attached to the auxiliary hoist drum by a separate second socket. The distance between the first sockets is substantially greater than the distance between the second sockets. More particularly, each first socket is adjacent to a separate end of the main hoist drum and the second sockets are at the central portion of the auxiliary hoist drum.

Aspects of the invention relate to a first (main) hoist system which, for whatever reason, is inoperative and the first drum cannot be rotated or intentionally is not rotated. As used in used in this specification, the first drum is understood to be maintained in a non-rotating mode when there has been a failure of any component of the hoist system of which the first drum comprises a part and the drum cannot be rotated. Such first drum is also understood to be so maintained if operation of such main hoist system is intentionally avoided for purposes of, e.g., testing the auxiliary hoist system.

The second drum is typically used only if the first drum (that normally used to move loads) is inoperative for some reason, e.g., a gearbox has failed. Other aspects of the invention involve a method for moving the load including the steps of maintaining the first drum in a non-rotating mode and rotating the second drum to move the load. When the load is at an elevated position, cable contacts the second hoist drum at two points of tangency and the rotating step includes moving the load to a lower elevation. The points of tangency are thereby moved toward one another. In another operating situation, the load is at a lowered position. The rotating step includes moving the load to a higher elevation, thereby moving the points of tangency away from one another.

Crane hoist systems often use what is termed a "bottom block" or "load block" to handle a load. Such a block has one or more pulley-like sheaves, cable on the sheaves and, for example, a hook at the lower portion of the block for picking up and carrying a load. Another aspect of the invention involves a load block with a "floating sheave" arrangement configured to minimize fleet angle.

The new load block includes an elongate bar-like or pin-like first support member which has a long axis and which extends between a pair of support plates. A first sheave assembly has a sheave which rotates about such axis. The assembly is mounted on the first support member for rotating and sliding movement with respect to the support member; sliding movement is limited by the plates.

There is also a cable guide mounted for movement in unison with sliding movement of the sheave assembly. However, the cable guide is mounted for pivoting movement independent of rotating movement of the sheave.

In a highly preferred embodiment, the load block has two support members and two sheave assemblies, one mounted on each support member. Like the first assembly and its support member, the second sheave assembly is mounted on the second support member for sliding and rotating movement.

In a double-sheave load block (a block with two support bars and two sheave assemblies), the sheaves are spaced by a dimension and such dimension increases when the load is lowered by the main hoist drum. And when the load is lowered by the auxiliary hoist drum, the dimension decreases. To put it another way, the sheaves move in a way that the fleet angle of cable extending from the block to the first drum and the fleet angle of cable extending from such block to the second drum are generally equal to one another.

Further details of the invention will become apparent from the following detailed description and from the drawing.

BRIEF DESCRIPTION OF THE DRAWING

FIG. 3 is a simplified top plan view of an arrangement showing the main and auxiliary hoist drums and the load block of the crane shown in FIG. 1.

FIG. 5 is an elevation view taken along the viewing plane 5—5 of FIG. 3. Parts are broken away.

FIG. 6 is an elevation view taken along the viewing plane 6—6 of FIG. 3. Parts are broken away.

FIG. 10 is a top plan view showing a sheave, cable and the concept of fleet angle. Parts are broken away.

DETAILED DESCRIPTION OF THE PREFERRED EMBODIMENTS

Figure 1:
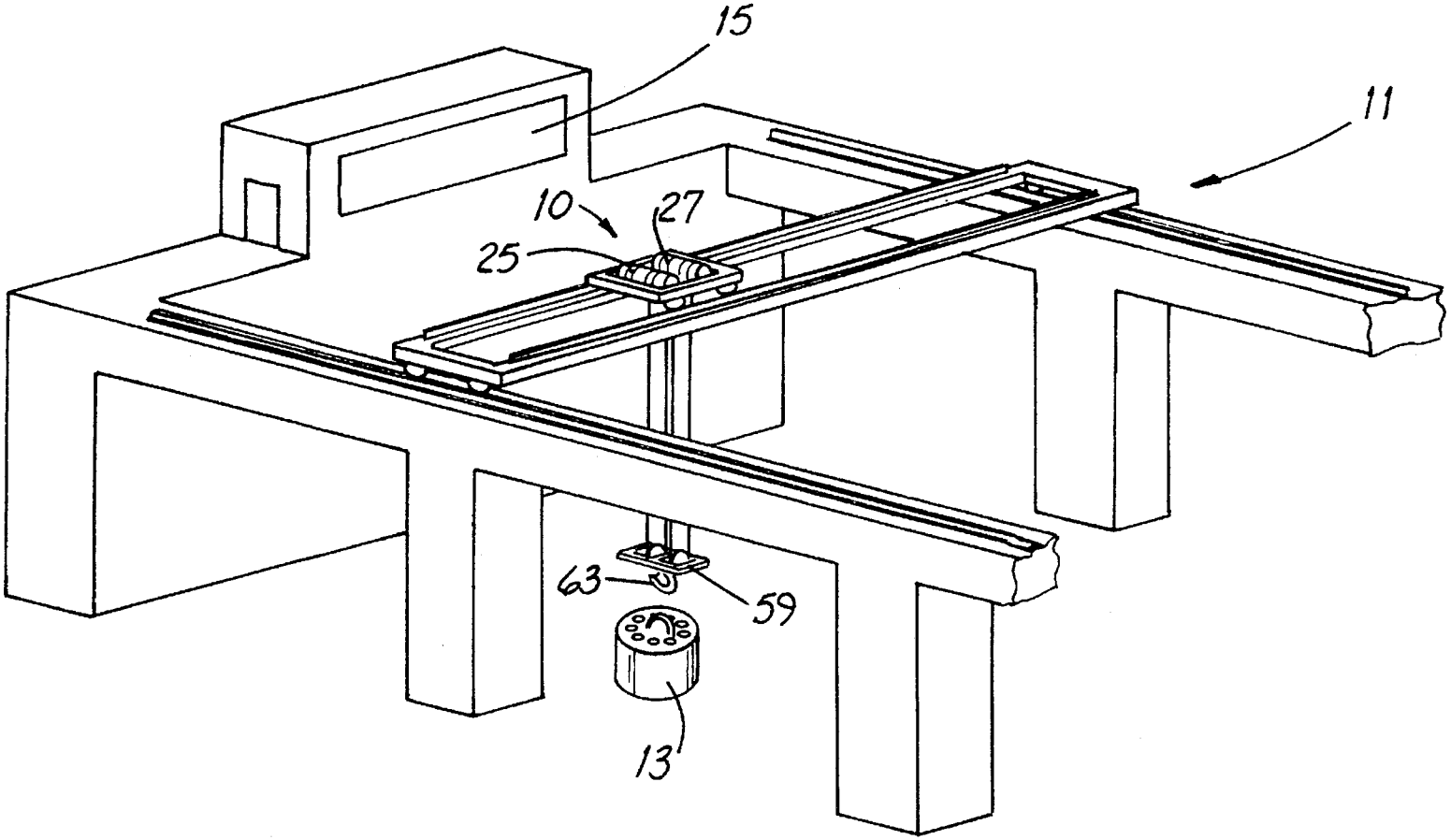
FIG. 1 is a representative perspective view of the inventive crane shown in conjunction with an exemplary facility in which the crane might be used.

An "overview" discussion will be helpful in understanding the more detailed aspects of the inventive crane 10 with redundant hoist arrangement. As shown in FIG. 1, an exemplary practical use of the inventive crane 10 involves a nuclear power facility 11. Such a facility handles hazardous loads 13 in the form of bundles of nuclear fuel rods which, in ready-to-use or "spent" form, need to be moved. However, it will become apparent that the invention has utility in any situation involving a need to have a redundant load-lifting and load-lowering capability.

Because nuclear fuel rods are radioactive, the crane 10 is preferably operated from a shielded enclosure 15 or even from a separate room. In the latter event, a screen displays crane movements as detected by a camera in the space where the crane 10 is operating.

An aspect of the invention involve a unique crane arrangement particularly useful for handling hazardous loads as described above. The crane 10 is controlled by an operator and exemplary operator's stations are shown in FIGS. 2A and 2B.

Figure 2A:
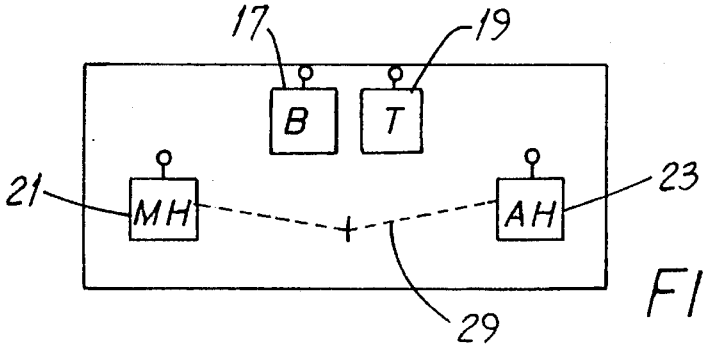
FIG. 2A is a representative plan view of one exemplary arrangement of an operator's station for controlling the crane shown in FIG. 1.

In the arrangement shown in FIG. 2A, there is a master switch 17 for controlling movement of the crane bridge, another master switch 19 for controlling movement of the crane trolley and two master switches 21, 23, one each for controlling the first or main hoist drum 25 and the second or auxiliary hoist drum 27, respectively. As symbolized by the dashed line 29, the master switches 21 and 23 are electrically or mechanically interlocked so that such master switches 21, 23 cannot be operated simultaneously.

Figure 2B:
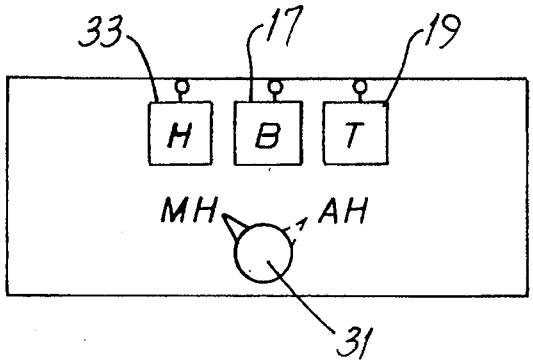
FIG. 2B is a representative plan view of another exemplary arrangement of an operator's station for controlling the crane shown in FIG. 1.

In the arrangement of FIG. 2B, a selector switch 31 is positioned by the operator to select whether the master switch 33 operates the main hoist drum 25 or the auxiliary hoist drum 27—but not both simultaneously. And there are other possible arrangements for achieving that result. But a common characteristic is that in the event of failure of the main hoist system, the load 13 can be moved up or down by the auxiliary hoist drum 27.

Figure 4:
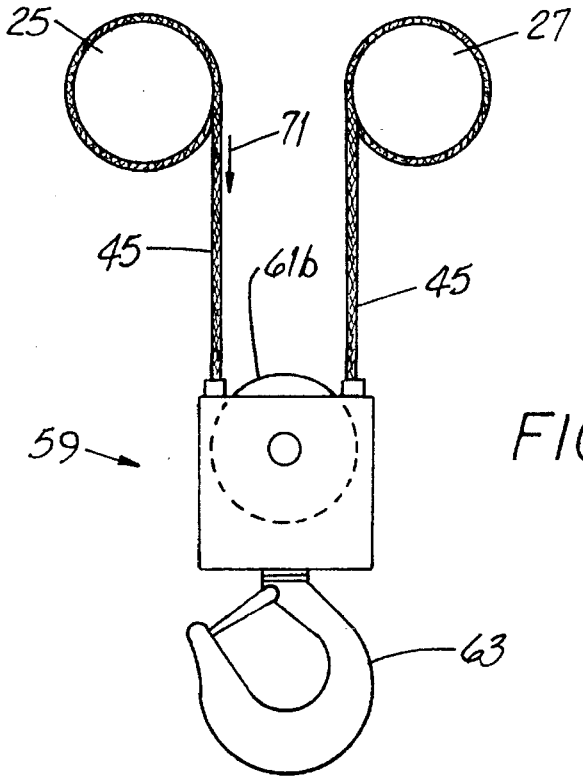
FIG. 4 is a simplified elevation view of the arrangement of FIG. 3 taken along the viewing plane 4—4 thereof. Surfaces of parts are shown in dashed outline.

Also considering FIGS. 3 and 4, in a highly preferred embodiment, the main hoist drum 25 and the auxiliary hoist drum 27 are of substantially equal length and diameter. The main hoist drum 25 has drum ends 35, 37 a drum central portion 39 and first and second cable grooves 41 and 43, respectively, which spiral about the drum 25 in opposite directions to one another. When the drum 25 is rotated clockwise (as viewed in FIG. 4), cable 45 is "payed out" from the drum 25 and the load 13 lowers.

Like the main hoist drum 25, the auxiliary hoist drum 27 also has drum ends 47, 49 a drum central portion 51 and first and second cable grooves 53 and 55, respectively, which spiral about the drum 27 in opposite directions to one another. Unlike the main hoist drum 25, when the auxiliary hoist drum 27 is rotated clockwise (as viewed in FIG. 4), cable 45 is retrieved and the load 13 raises.

On each drum 25, 27 cables 45 are attached or "anchored" to the drum 25, 27 by clamp-like sockets 57. On the main hoist drum 25, the sockets 57 are spaced apart and each is adjacent to a drum end 35 or 37. On the auxiliary hoist drum 27, the sockets 57 are adjacent to one another and are at the drum central portion 51. Viewed another way, each groove 41, 43 or 53, 55 of each drum 25 or 27, respectively, is bounded at one end by a cable-attachment socket 57.

A feature of the invention is that depending upon the position of the load 13 (i.e., fully raised, fully lowered or somewhere in between) when the auxiliary hoist drum 27 is used, such auxiliary drum 27 may have up to twice the length of cable 45 wrapped about it as is ever wrapped about the main hoist drum 25. The way in which this can occur and the reason therefor is explained below. Since it may be difficult for some persons to visualize the variety of conditions described below, such conditions and operating features are explained in several different ways using several different types of FIGURES to do so.

Both drums 25, 27 are attached by cable 45 to a load block 59 which has a pair of rotatable, axially-movable, pulley-like sheaves 61*a*, 61*b* under which the cable 45 passes. The load block 59 also has a hook 63 (or a sling or other load-attaching device, not shown) for attachment to the load 13. The load block 59 is described in greater detail below.

Referring additionally to FIGS. 5 and 6, the cable 45 extending between the main hoist drum 25 and the load block 59 contacts the main hoist drum 25 at first points of tangency 65*a*, 65*b*. Similarly, the cable 45 contacts the auxiliary hoist drum 27 at second points of tangency 67*a*, 67*b*. Each point of tangency 65, 67 is defined by the "meeting" of a straight line, represented by the cable 45, and a curve as represented by the drum groove surface 69. This feature is also illustrated in FIG. 4.

Recalling that when the main hoist drum 25 rotates clockwise (as viewed in FIG. 4 or along viewing axis VA5 in FIG. 3), cable 45 pays out in the direction of the arrows 71, the block 59 is lowered and the distance between the first points of tangency 65*a*, 65*b* increases. On the other hand, the arrangement of the auxiliary hoist drum 27 requires that such drum 27 rotate counterclockwise (as viewed in FIG. 4 or along viewing axis VA6) to lower the block 59. During lowering, the distance between the second points of tangency 67*a*, 67*b* decreases.

Figure 7:
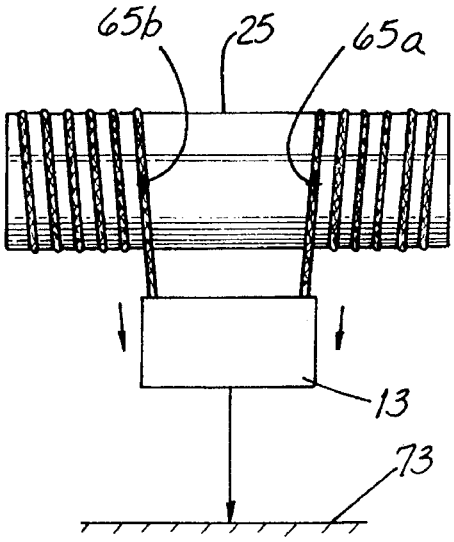
FIGS. 7, 8 and 9 comprise a sequence of simplified views taken along the viewing plane 5—5 of FIG. 3 and showing the main hoist drum lowering a load. Parts are broken away.
Figure 8:
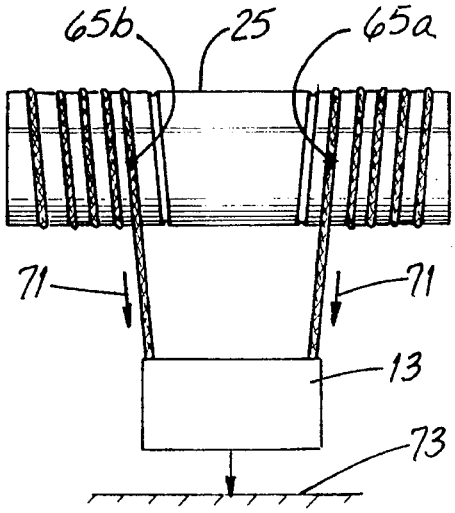
Figure 9:
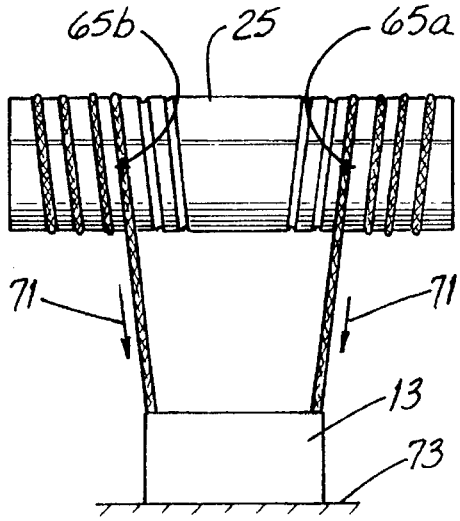

As noted above, visualization of the foregoing may be somewhat difficult. FIGS. 7, 8 and 9 provide an additional "visual aid." Such FIGURES (which are taken along viewing plane 5—5 of FIG. 3) constitute a sequence representing the main hoist drum 25 and the first points of tangency 65*a*, 65*b* as a load 13 is being lowered. In FIG. 7, the load 13 is fully raised or nearly so. In FIG. 8, the load 13 is partially lowered and in FIG. 9, the load 13 is fully lowered to rest on a floor.

It is now more readily seen how the distance between the first points of tangency 65*a*, 65*b* increases as the load 13 is lowered using the main hoist drum 25. And it is apparent that a similar depiction of the auxiliary hoist drum 27 would illustrate how the distance between the second points of tangency 67*a*, 67*b* decreases as the load 13 is lowered.

Referring further to FIG. 3, yet other features of the invention will now be described. In FIG. 3, the load block 59 is shown in a fully raised position. It is to be noted that when the block 59 is so located, about one-half of the total length of the main hoist drum 25 is wrapped with cable 45. Stated another way, cable 45 is wrapped on about the lower one-quarter and the upper one-quarter ("lower" and "upper" as viewed in FIG. 3) of the drum 25. In a highly preferred arrangement, only the lower and upper one-quarters of the drum 25 are so wrapped; the central portion 39 is devoid of cable 45.

It is also to be noted that about one-half of the total length of the auxiliary hoist drum 27 is also wrapped with cable 45. However, such one-half length is at the central portion 51 of such drum 27; the portions near the ends 47, 49 have no cable 45 wrapped thereon when the load 13 is fully raised and has been raised by the main hoist drum 25.

Understanding of the following portion of the specification will be aided by first having an appreciation of the term "fleet angle." Referring to FIG. 10, the fleet angle is the included angle "FA" between a sheave-engaging cable 45 and the plane 75 of sheave rotation. In FIG. 10, the cable segment 45*a* is aligned with the groove 77 in a sheave 61 across which the cable 45 travels and the fleet angle is substantially zero. In contrast, the cable segment 45*b* is "cocked" and enters or leaves the sheave 61 at a fleet angle "FA." Some of the problems which can arise from excessive fleet angle are outlined above in the Background.

Aspects of operation of the inventive crane 10 will now be described. Referring again to FIG. 3, it is assumed that the load 13 is to be lowered in a normal way, i.e., using the main hoist drum 25. To do so, the drum 25 is rotated clockwise as viewed in FIG. 4, the distance between the first points of tangency 65*a*, 65*b* increases and when the load 13 comes to rest on a floor 73, the points of tangency 65*a*, 65*b* are near the drum ends 35, 37, respectively. That is, there may be only one or a few wraps of cable 45 left on each end 35, 37 of the drum 25. Loads 13 can be raised and lowered repetitively in the normal way.

The sheaves 61*a*, 61*b* of the load block 13 can move axially (up or down as viewed in FIG. 3) on their respective support members 79, 81. Because of such sheave movement, the fleet angles are maintained at acceptably low values as a load 13 is raised and lowered.

To illustrate the arrangement and operation of the auxiliary drum 27, it is now assumed that the load 13 is fully raised (as in FIG. 3) and that, for whatever reason, the main hoist drum 25 is maintained in a non-rotating mode. It is also assumed that the load 13 is of a type, e.g., a hazardous load, required to be lowered before the time operation of the main hoist drum 25 is likely to be restored.

To lower the load 13, the auxiliary drum 27 is rotated in a counterclockwise direction (as viewed in FIG. 4) and as cable 45 pays out, the second points of tangency 67*a*, 67*b* move closer together. If operation of the main hoist system is restored after the load 13 is lowered, it is nevertheless preferred that the load 13 or the empty load block 59 be again brought to its fully raised position by the auxiliary hoist drum 27 before placing the main hoist drum 25 back into operation. This procedure avoids "transferring" cable 45 from the auxiliary hoist drum 27 to the main hoist drum 25.

The manner in which the auxiliary drum 27 is used to raise a fully lowered load 13 will now be explained. For this explanation, it is assumed the load 13 is fully lowered by the main hoist drum 25. When so lowered, there is little cable 45 left on the main hoist drum 25. Because the first points of tangency 65*a*, 65*b* become further apart during such lowering, the sheaves 61*a*, 61*b* also become further apart as they move axially and maintain the fleet angles at acceptably low values.

To raise a fully-lowered load 13 using the auxiliary drum 27, such drum 27 is rotated clockwise (as viewed in FIG. 4), cable 45 is retrieved on the drum 27 and the second points of tangency 67*a*, 67*b* become further apart. Such movement of such points of tangency 67*a*, 67*b* is in a direction which reduces the fleet angle at the block 59. It is also to be appreciated that during such load raising, the auxiliary drum 27 becomes substantially entirely wrapped with cable 45.

Figure 11:
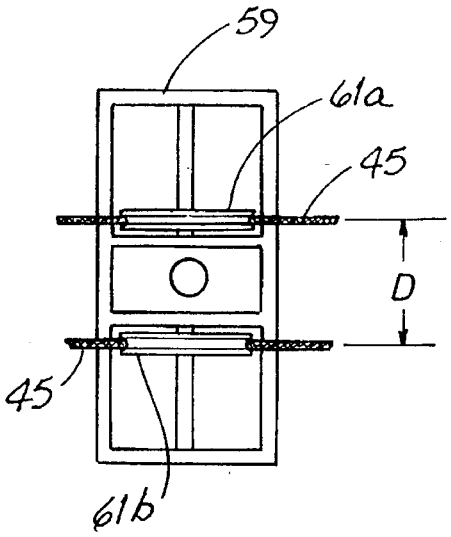
FIGS. 11, 12, 13 and 14 are top plan views of a crane load block showing cable and floating sheaves in positions resulting from raising or lowering a load using the main hoist drum or the auxiliary hoist drum.
Figure 12:
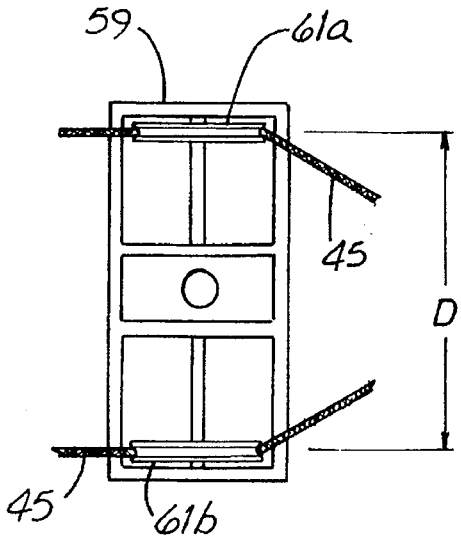

The foregoing explanation is more fully appreciated by reference to FIGS. 11, 12, 13 and 14. FIG. 11 shows the load block 59 and cable 45 when the load 13 has been fully raised by the main hoist drum 25. FIG. 12 shows the load block 59 and cable 45 when the load 13 has been fully lowered by the main hoist drum 25. FIGS. 11 and 12 are presented on the assumption that the auxiliary hoist drum 27 is as shown in FIG. 3, i.e., prepared to either hoist or lower a load 13. That is, about one-half the length of such drum 27 (at the drum central portion 51) is wrapped with cable 45.

Figure 13:
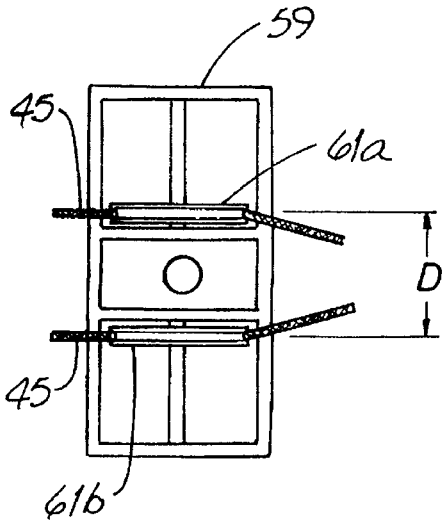
Figure 14:
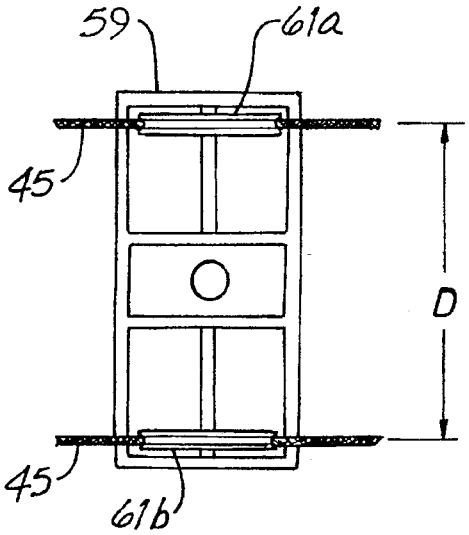

FIG. 13 shows the load block 59 and cable 45 after the load 13 has been fully raised by the main hoist drum 25 and subsequently lowered by the auxiliary drum 27. FIG. 14 shows the load block 59 and cable 45 after the load 13 has been fully lowered by the main hoist drum 25 and subsequently raised by the auxiliary drum 27.

In the condition illustrated by FIG. 14, the auxiliary drum 27 would be substantially entirely wrapped with cable 45 and, thus, has about twice the length of cable 45 wrapped thereon as in the condition illustrated in FIG. 3. The reason therefor is that cable 45 normally wrapped on the main drum 25 has been temporarily "transferred" to the auxiliary drum 27.

Considered in yet another way and appreciating that the arrangement of the auxiliary drum 27 shown in FIG. 3 is a nominal "starting" arrangement, the auxiliary drum 27 has enough cable 45 wrapped thereon to pay out cable 45 and lower the load 13 if such load 13 is in a fully raised position when the main hoist drum 25 becomes inoperative. And the auxiliary drum 27 also has sufficient "empty" grooves 53, 55 thereon to retrieve cable 45 and raise the load 13 if such load 13 is in a fully lowered position when the main hoist drum 25 becomes inoperative.

Figure 15:
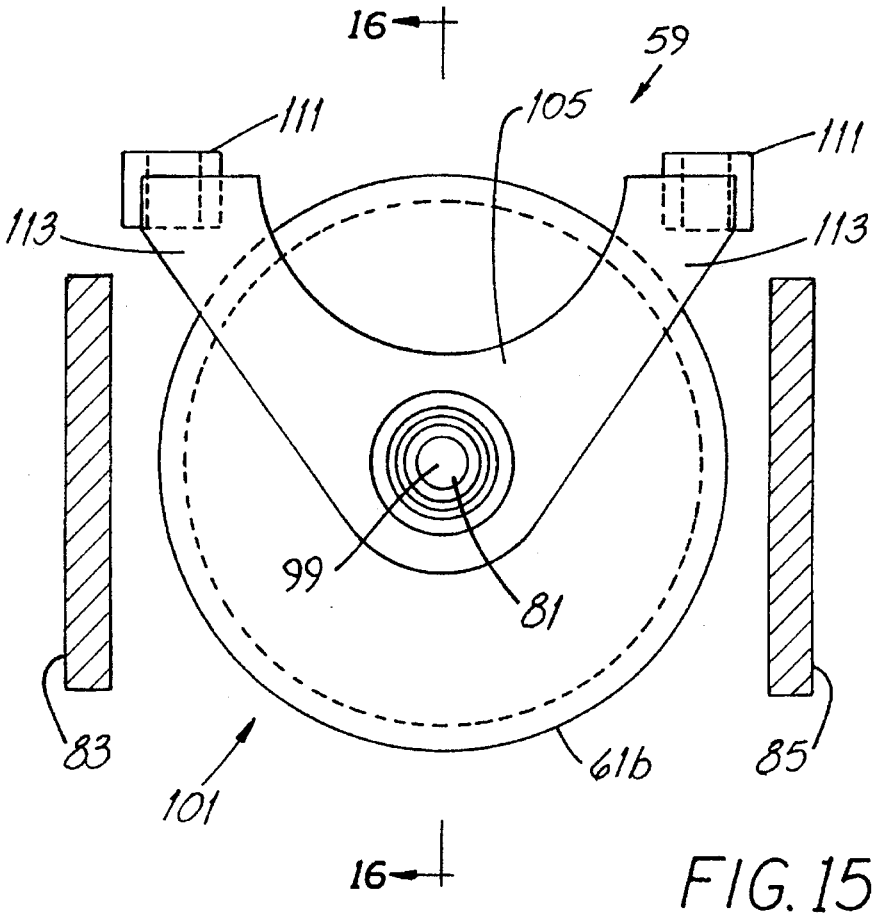
FIG. 15 is a simplified elevation view of aspects of the crane load block taken along the viewing plane 15—15 of FIG. 3.
Figure 16:
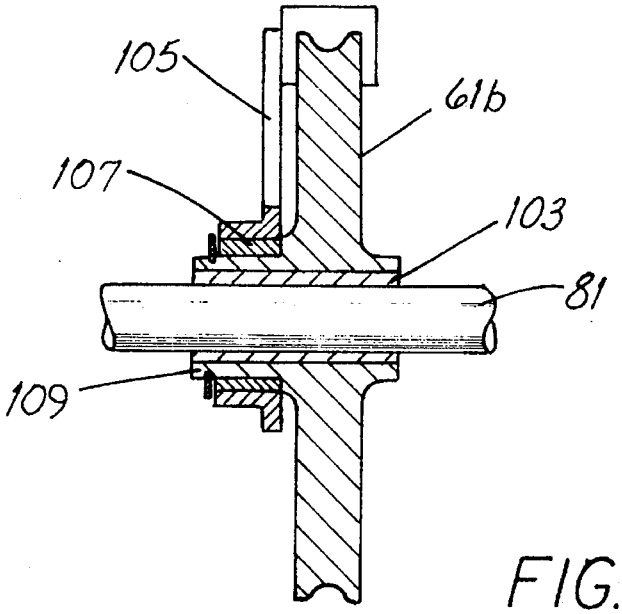
FIG. 16 is an elevation view of aspects of the load block of FIG. 15 taken along the viewing plane 16—16 thereof.

Another aspect of the invention involves the new load block 59 which has a "floating sheave" arrangement configured to minimize fleet angle. Referring again to FIGS. 3 and 4 and also to FIGS. 15 and 16, the new load block 59 includes a pair of side frames 83, 85 a pair of end support plates 87, 89 extending between the side frames 83, 85 and a pair of interior support plates 91, 93 also extending between the side frames 83, 85. The plates 89 and 91 limit travel of the first sheave 61*a* while the plates 87 and 93 limit travel of the second sheave 61*b*. A load-lifting hook 63 is attached to the block bottom panel 95.

Since the load block 59 is substantially symmetrical about each of two vertical planes 97*a*, 97*b* only one floating sheave arrangement need be described. Extending between the plates 87 and 93 is an elongate bar-like or pin-like first support member 81 having a long axis 99. A first sheave assembly 101 has a sheave 61*b* which rotates about such axis 99. The assembly 101 is mounted on the first support member 81 for rotating and sliding movement with respect to the support member 81; sliding movement is limited by the plates 87 and 93. In the exemplary embodiment, the sheave 61*b* is mounted on a sleeve bearing 103 interposed between the sheave 61*b* and the support member 81.

The assembly 101 also has a cable guide 105 mounted for movement in unison with sliding movement of such assembly 101. However, the cable guide 105 is mounted for pivoting movement independent of rotating movement of the sheave 61*b*. More specifically, the cable guide 105 is mounted "piggy back" on another sleeve bearing 107 interposed between the guide 105 and the annular sheave extension 109 and, thus, is free to pivot with respect to the sheave 61*b*. In the illustrated embodiment, the cable guide 105 is generally U-shaped and has a tube-like guide ferrule 111 at the end of each arm 113. In use, cable 45 is threaded through each ferrule 111 and the ferrules 111 help prevent cable 45 from "jumping" off of the sheave 61*b*.

In a highly preferred embodiment, the load block 59 has two support members 79, 81 and two sheave assemblies 101, 102, one mounted on each support member 81, 79, respectively. Like the first assembly 101 and its support member 81, the second sheave assembly 102 is mounted on the second support member 79 for sliding and rotating movement.

In a double-sheave load block 59 (a block 59 with two support bars 79, 81 and two sheave assemblies 101, 102), the sheaves 61*a*, 61*b* are spaced by a dimension "D" and as illustrated by a comparison of FIGS. 11 and 12, such dimension "D" increases when the load 13 is lowered by the main hoist drum 25. And as illustrated by a comparison of FIGS. 14 and 13 in that order, when the load 13 is lowered by the auxiliary hoist drum 27, the dimension "D" decreases. To put it another way, the sheaves 61*a*, 61*b* move in a way that the fleet angle of cable 45 extending from the block 59 to the first drum 25 and the fleet angle of cable 45 extending from such block 59 to the second drum 27 are generally equal to one another.

While the principles of the invention have been described in connection with specific embodiments, it is to be understood clearly that such embodiments are exemplary and not limiting.

I claim:

1. In a crane having (a) a first hoist drum, (b) a second hoist drum spaced substantially horizontally from the first hoist drum, and (c) a load block below the drums and having a load suspended therefrom, and wherein:

a pair of cables extends from the drums substantially vertically downward to the block for raising and lowering the load;

the load block is interposed between the pair of cables and the load;

the load is at an elevated position;

the drums are independently powered;

each hoist drum is capable of independently raising and lowering the load without load tilting; and the pair of cables contact the second hoist drum at two points of tangency;

a method for moving the load including the steps of:

maintaining the first drum in a non-rotating mode; and, rotating the second drum to move the load to a lower elevation, thereby moving the points of tangency toward one another.

2. The method of claim 1 wherein the load is at a lowered position, and the rotating step includes:

moving the load to a higher elevation, thereby moving the points of tangency away from one another.

3. The method of claim 1 wherein the load block includes plural sheaves which are spaced by a dimension and are substantially parallel to one another, and the rotating step includes:

rotating the second hoist drum to raise the load; and increasing the dimension.

4. The method of claim 1 wherein the load block includes plural sheaves spaced by a dimension, and the rotating step includes:

rotating the second hoist drum to raise the load; and decreasing the dimension.

5. The method of claim 1 wherein the load block includes a first support member and a first sheave mounted on the first support member for sliding movement with respect to such first support member and the rotating step includes sliding the first sheave along the first support member.

6. The method of claim 5 wherein the load block includes a second support member and a second sheave mounted on the second support member for sliding movement with respect to such second support member and the rotating step includes sliding the second sheave along the second support member.

* * * * *